United States Patent [19]

Merz

[11] 4,357,855

[45] Nov. 9, 1982

[54] RADIATION RESISTANT PROJECTILE CANISTER LINER

[75] Inventor: Paul L. Merz, San Diego, Calif.

[73] Assignee: The United States of America as represented by the Secretary of the Navy, Washington, D.C.

[21] Appl. No.: 211,960

[22] Filed: Dec. 1, 1980

[51] Int. Cl.[3] ..... F41F 3/00

[52] U.S. Cl. ..... 89/1.816; 89/1.819; 428/465

[58] Field of Search ..... 89/1.8, 1.816, 1.819; 428/36, 167, 422, 465

[56] References Cited

U.S. PATENT DOCUMENTS

| | | | |
|---|---|---|---|
| 3,124,040 | 3/1964 | Fiedler | 89/1.816 |
| 3,166,978 | 1/1965 | Price et al. | 89/1.816 |
| 3,182,469 | 5/1965 | Kirchner | 62/467 R |
| 3,243,313 | 3/1966 | Aves, Jr. | 428/105 |
| 3,285,799 | 11/1966 | Peterson | 428/167 |
| 3,610,096 | 10/1971 | Bauman et al. | 89/1.816 X |
| 3,635,787 | 1/1972 | Shanok et al. | 428/167 |
| 3,857,321 | 12/1974 | Cohen | 89/1.816 X |
| 3,895,982 | 7/1975 | Persson | 428/167 X |
| 4,068,034 | 1/1978 | Segawa et al. | 428/465 X |
| 4,238,137 | 12/1980 | Furchak et al. | 428/422 X |

FOREIGN PATENT DOCUMENTS

| | | | |
|---|---|---|---|
| 1183117 | 1/1959 | France | 428/465 |

*Primary Examiner*—David H. Brown
*Attorney, Agent, or Firm*—Robert F. Beers; Ervin F. Johnston; Thomas Glenn Keough

[57] ABSTRACT

A liner for lining the interior surface of a canister which carries and supports the launching of a projectile includes a first resilient layer, a second thermally reflective layer, and a third layer having a low coefficient of friction. The first layer contacts the inner surface of the canister, the second layer is interposed between the first and third layer, and the third layer contacts the outer surface of the projectile.

6 Claims, 2 Drawing Figures

RADIATION RESISTANT PROJECTILE CANISTER LINER

STATEMENT OF GOVERNMENT INTEREST

The invention described herein may be manufactured and used by or for the Government of the United States of America for governmental purposes without the payment of any royalties thereon or therefor.

BACKGROUND

This invention relates to containers for storing and supporting the launch of fuel burning, self propelled projectiles. More particularly, it relates to sleeves for lining the interiors of such canisters. With still greater particularity, it relates to durable projectile canister liners having multiple layers of differing materials.

In the prior art a missile tube lining system is disclosed in U.S. Pat. No. 3,124,040 issued Mar. 10, 1964. In that system, a rubber mat with spaced annular fins is coated with Teflon or nylon, formed into a tubular sleeve with the fins projecting toward the sleeve's center from the inner surface, and placed in a missile tube where it forms a buffer or support system for a missile to be carried within the tube. As a liner for a projectile canister, the prior art system is susceptible to the thermal radiation emitted by the projectile's burning propellant. The coating of the prior art system is essentially transparent to the radiation which is deposited in the rubber mat. This radiation can be intense enough (4500 watts/in$^2$/sec in the case of a projectile known to the inventor) to vaporize the surface of the rubber mat and destroy the bond between the rubber mat and the coating. The coating can then be blown off the mat and the liner destroyed. This, of course, limits the liner's useability to a single launch.

The novel projectile canister liner disclosed and described herein overcomes the limitations of the prior art devices through a unique heat-tolerant feature which increases its durability and a design which provides superior load deflection properties.

SUMMARY OF THE INVENTION

The inventor's novel radiation resistant projectile canister liner consists of a first layer of resilient material formed into a sheet having a grooved surface on one side and a smooth surface on the other side with the grooved surface contacting the inner surface of the canister. A second layer of thermally reflective material formed into a sheet covers and is attached to the smooth surface of the first layer. A third layer of material having a low coefficient of friction which is formed into a sheet covers and is attached to the second layer. The third layer of material is essentially transparent to the radiation reflected by the second layer.

The grooved surface of the first layer provides superior load deflection properties. The reflective layer forms a barrier to thermal radiation which prevents vaporization of the surface of the first layer and allows multiple use of the liner.

OBJECTS OF THE INVENTION

Accordingly, it is an object of the invention to provide an improved liner for a projectile canister.

Another object is the provision of a projectile canister liner which is resistant to the thermal radiation emitted by the projectile during launch.

Still another object is the provision of a radiation resistant liner for a projectile canister which provides superior load bearing properties.

Still another object is the provision of a radiation resistant liner for a projectile canister which provides superior load bearing properties.

A still further object is the provision of an improved liner for a projectile canister which has the capability of surviving multiple projectile launches.

Other objects and advantages of the invention disclosed and described herein will be readily appreciated as the invention becomes better understood by reference to the following detailed description when considered in connection with the accompanying drawings.

DESCRIPTION OF THE PREFERRED EMBODIMENT

Figure 1:
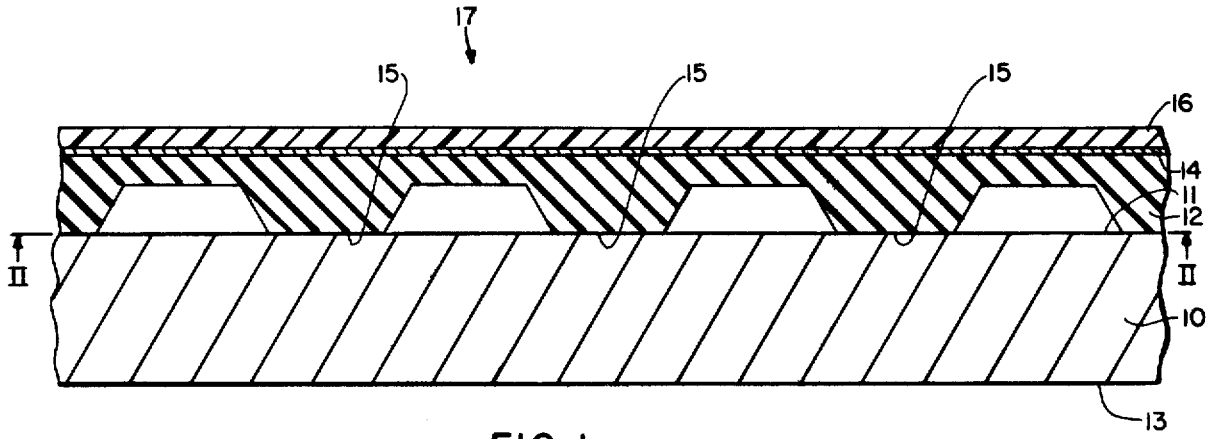
FIG. 1 is a cross sectional view of the invention.

With reference now to FIG. 1 there is shown a partial cross-sectional view of a projectile canister 10 having an inner surface 11 and an outer surface 13. The canister is in the form of an elongated tube partly closed at one end and constructed from an aluminum compound. The canister is designed to receive, carry, and support the launch of a self-propelled projectile such as a missile. During carriage and handling a suspension system must be provided between the canister and the projectile to give load deflection and shock attenuation and thereby prevent damage which might be caused by relative motion between the canister and the projectile.

During launch a seal must be maintained between the inner surface of the canister and the outer surface of the projectile in order to allow the creation of launch pressure. However, the contact between the canister and the projectile must provide minimum coefficients of friction in order not to retard the movement of the projectile during launch.

Finally, the canister must be protected from ablation by the highly errosive propellant exhaust. Without such protection, the high rate of ablation attendant with a launch would render a canister unuseable. A non-reloadable canister which must be discarded after each firing adds greatly to the cost of a projectile system.

FIG. 1 illustrates a novel lining for a launch canister which will protect the canister and projectile from shock under service conditions, provide a low friction surface to permit the projectile to exit smoothly during launching, and protect the canister from ablation by the projectile exhaust plume. Further, the structure of the liner allows it to survive multiple launches.

The liner 17 of the invention is formed into a tube which fits annulately to the inner surface 11 of the canister 10. The tube is constructed of coaxial layers of differing materials: a supple inner layer, a reflective second layer, and a low friction third layer.

The inner layer 12 of the liner consists of a supple, resilient material having a grooved surface with lands 15 which contact the inner surface 11 of the canister 10. The opposite surface of the inner layer 12 is smooth. The inner layer 12 may be constructed using one of the class of resilient materials containing rubber.

Bonded to and disposed over the smooth surface of the inner layer 12 is a relatively thin second layer 14 composed of a material which is reflective of the thermal radiation emitted from the exhaust plume of the projectile during launch. The second layer 14 can comprise, for example, a thin reflective foil comprising polished aluminum or nickel.

Disposed over and bonded to the second layer 14 is a third layer 16 composed of a material, such as fluorocarbon resin or polytetrafluoroethylene, having low coefficients of friction and which is transparent to the thermal radiation reflected by the second layer 14.

Figure 2:
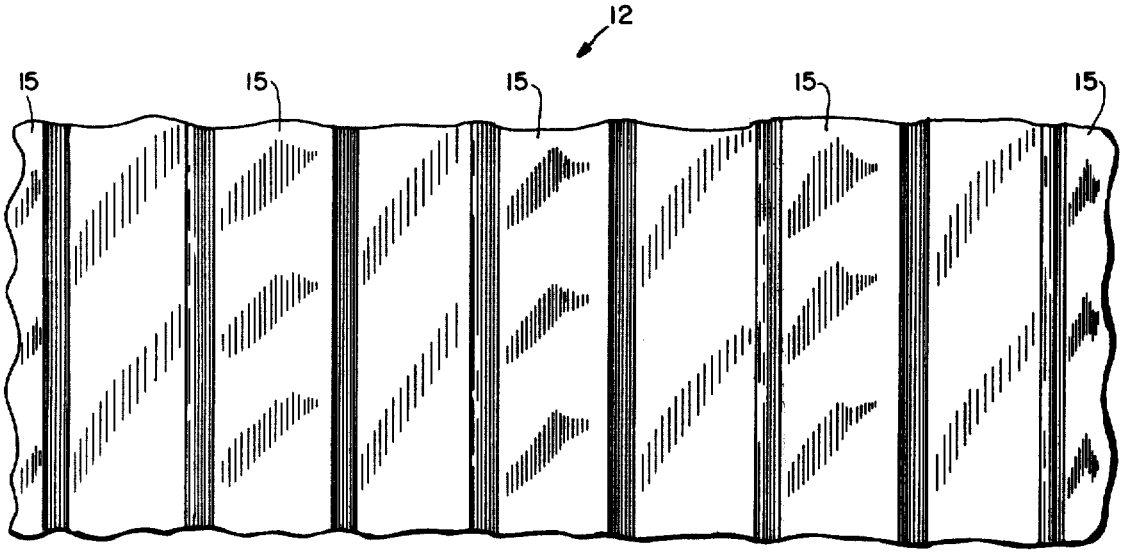
FIG. 2 is a partial sectional view of the grooved surface of the first layer of the invention, taken along plane II—II of FIG. 1.

The load deflection and shock attenuation properties of the liner 17 are provided by the resiliency of the material selected for the inner layer 12 and by its grooved surface which is clearly shown in FIG. 2. The lands 15 give the inner layer 12 a superior suspension capability by widely distributing any load. Orienting the lands to contact the inner surface 11 of the canister 10 ensures that a smooth surface will be presented to the projectile thus maximizing the seal between the canister 10 and the projectile.

The reflective properties of the second layer 14 prevent the thermal radiation penetrating and degrading the surface of the inner layer 12, ensuring that the liner is preserved intact for successive launches.

The third layer 16, presenting a smooth surface to the projectile, maximizes the canister-to-projectile seal. Selection of a material like polytetrafluoroethylene, having the properties of low coefficient of friction and low coefficients of thermal and chemical activity, will ensure that a canister using the liner of the invention provides a smooth, easy launch of a projectile and also a durability which will allow a multiplicity of launches. The life of this novel liner is limited only by the normal ablatic rate of the third layer of material.

Production of the invention can comprise a straightforward process of sandwiching the reflective layer, with adhesive applied to its upper and lower surfaces, between the grooved inner layer, which is contained in a mold, and the third layer. The mold is heated to allow the adhesive to bond all layers. The finished liner of the invention can then be adhesively bonded to the interior of a canister.

Obviously, many modifications and variations of the present invention are possible in the light of the above teachings, and, it is therefore understood that within the scope of the disclosed inventive concept, the invention may be practiced otherwise than as specifically described.

What is claimed is:

1. A radiation resistant liner for a projectile canister, comprising:

a first layer of resilient material formed into a sheet having a grooved surface on one side and a smooth surface on the other side, the lands of the grooved surface bonded to the inner surface of the canister;

a second layer of thermally reflective material formed into a sheet covering and bonded to the smooth surface of the first layer; and a third layer of material having low coefficients of friction and low coefficients of thermal and chemical activity formed into a sheet covering and bonded to the second layer, the third layer material being essentially transparent to the radiation reflected by the second layer.

2. A liner as in claim 1 wherein the resilient material comprises rubber.

3. A liner as in claim 1 wherein the reflective material comprises a metal selected from the group containing aluminum and nickel.

4. A liner as in claim 1 wherein the third layer material is selected from the class of materials containing fluorocarbon resin and polytetrafluoroethylene.

5. A liner as in claim 4 wherein the resilient material comprises rubber.

6. A liner as in claim 5 wherein the reflective material comprises a metal selected from the group containing aluminum and nickel.

* * * * *